United States Patent [19]

Gorman, Jr.

[11] Patent Number: 4,618,800

[45] **Date of Patent: * Oct. 21, 1986**

[54] PRECISION ELECTRODE ALIGNMENT

[75] Inventor: Kenneth G. Gorman, Jr., Capitola, Calif.

[73] Assignee: Rank Electronic Tubes, Inc., Scotts Valley, Calif.

[ * ] Notice: The portion of the term of this patent subsequent to Feb. 21, 2003 has been disclaimed.

[21] Appl. No.: 467,343

[22] Filed: Feb. 17, 1983

[51] Int. Cl.[4] ..... H01J 29/48; H01J 29/82

[52] U.S. Cl. ..... 313/417; 313/457

[58] Field of Search ..... 313/457, 456, 482, 417

[56] References Cited

U.S. PATENT DOCUMENTS

| | | | |
|---|---|---|---|
| 2,947,897 | 8/1960 | Rodriguez et al. | 313/457 X |
| 3,239,708 | 3/1966 | Johnson | 313/457 |
| 3,961,220 | 6/1976 | Say | 313/417 |
| 4,305,018 | 12/1981 | Paridaens | 313/417 |
| 4,338,543 | 7/1982 | Handel | 313/457 |

*Primary Examiner*—Palmer C. DeMeo
*Assistant Examiner*—Sandra L. O'Shea
*Attorney, Agent, or Firm*—Ernest M. Anderson

[57] ABSTRACT

The electrodes in a tube, such as a cathode ray tube, are held in accurate alignment, particularly under conditions of high stress, by employing a series of glass rods along the electrodes with a plurality of U-shaped straps extending over the rods and forming a tight fit between the rods and the neck of the tube with the legs of the U being bowed outwardly under tension.

5 Claims, 6 Drawing Figures

PRECISION ELECTRODE ALIGNMENT

SUMMARY OF THE INVENTION

The present invention relates primarily to a method of holding the electrodes within the neck of a cathode ray tube but it also can be applied to other electron devices such as traveling wave tubes and backward wave oscillators and the like. The invention is described primarily in terms of a cathode ray tube since this is the primary application.

A number of methods have been proposed in the past to align the gun or electrodes of a cathode ray tube within the neck of the tube. Modern electron guns consist of a plurality of cylindrical metal parts supported and aligned in position by two or more glass pillars or rods to form a self-supporting structure. This structure must be held in alignment with and may be supported from the cylindrical wall section of the electron tube.

The support serves two important purposes. In the first place in precision applications, it is necessary that the gun be accurately positioned within the neck of the tube. Secondly, in many applications of cathode ray tubes, particularly military applications such as airplanes or tanks wherein the CRT may be subjected to vibration or shock from a cannon or machine gun, it is necessary to hold the electrodes firmly during conditions of extreme stress.

Various methods have been proposed in the past such as spring arrangements between the gun neck and wall, pins or studs attached radially to the electron gun parts which bear on the neck wall or pins and studs attached radially to the gun parts and fused to or through the neck wall. None of these devices has proved satisfactory for a variety of reasons. Spring arrangements may become softened during tube processing, weakening the springs and permitting the elements to vibrate. The springs may differ in tension so that the electron gun is not maintained concentric to the tube neck. Additionally, spring elements may have resonances so that the tube may be subjected to excessive G forces during vibration.

The use of studs has not proved satisfactory since it is difficult to adjust the stud lengths so that the studs will just bear on the glass neck wall without any gaps. If the studs are too long, there will be undue stress affecting either the glass integrity or the alignment of the electron guns. If one or more studs is too short, the gun simply rattles around and the support method fails.

The use of metal studs which extend into the neck of the tube causes stress at the boundry which can result in glass strain affecting the integrity of the glass envelope and/or the alignment of the parts.

In accordance with the present invention, one first starts by employing a plurality of glass pillars or rods which lie parallel to the electrodes and which have mounting pins connecting the rods to the individual electrodes. This method has long been used to hold the various electrodes in alignment. In accordance with the present invention, the inside neck of the tube is ground, shrunk or otherwise formed to a critical dimension. The outside surface of the glass rods is then ground or otherwise formed so that the pillars or rods have an outer surface which is congruent to and slightly spaced from the inner surface of the neck. U-shaped straps are then placed over the glass rods and the legs of the U fastened, as by spot welding, to the electrodes. The bight of the U does not conform closely to the surface of the glass rod but instead there is a sight gap at the edges of the rod. Now the assembly is pushed into the neck of the tube which causes the bight of the U-shaped structure to confrom and fill up the space between the inner surface of the neck and the outer surface of the rod. This causes the legs of the U to be forced outwardly under tension so that there is a slight amount of tension at all times on the support member. In this manner, the electrodes are accurately positioned within the neck of the tube and there is sufficient friction between the metal straps and the glass wall so as to preclude slippage, sliding and any other movement. There is no resonance point and the method is highly reproducible. Thus, it suffers from none of the defects previously outlined.

Other features and advantages of the invention will be brought out in the balance of the application.

DESCRIPTION OF THE PREFERRED EMBODIMENTS

Figure 1:
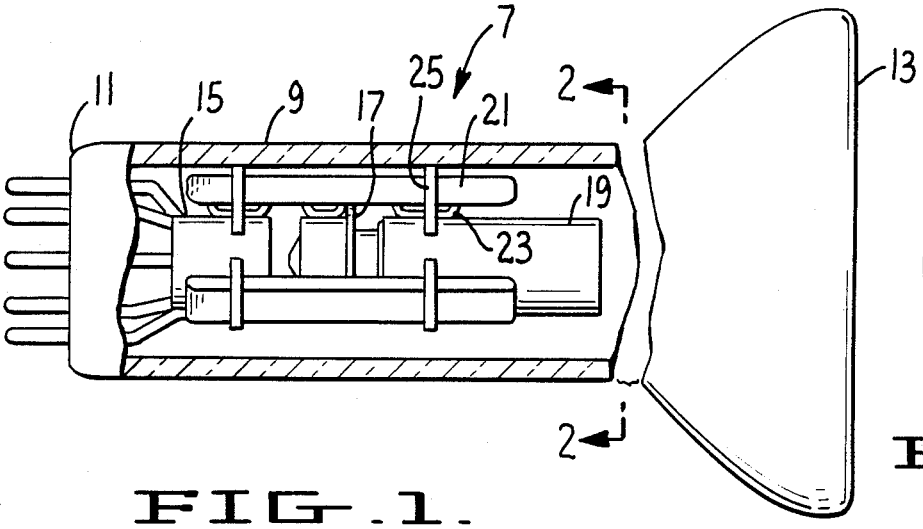
FIG. 1 is a side view of a cathode ray tube, partly in section, embodying the present invention.
Figure 2:
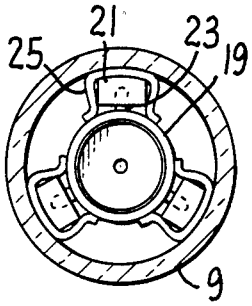
FIG. 2 is a section on the line 2—2 of FIG. 2.

Referring now to the drawings by reference characters, there is shown in FIGS. 1 and 2 a CRT generally designated 7 having a cylndrical neck 9, a base 11 and screen 13. Within the neck 9 are a plurality of cylindrical electrodes such as grid-1,15 grid-2,17 and a focusing electrode 19. The electrodes 15, 17 and 19 are held in alignment by a plurality of glass rods 21 which are attached to each of the electrodes by metal pins 23 which are spot welded to the electrodes and extend into the glass rod. The structure thus far described is conventional in cathode ray tubes and it will be understood that such tubes frequently have more electrodes and in different configurations so that the embodiment described is given only for purposes of illustration.

In accordance with the present invention, a plurality of metal straps such as the one designated 25 are attached to the electrodes and extend around the glass rods between the rod and the neck of the tube.

Figure 3:
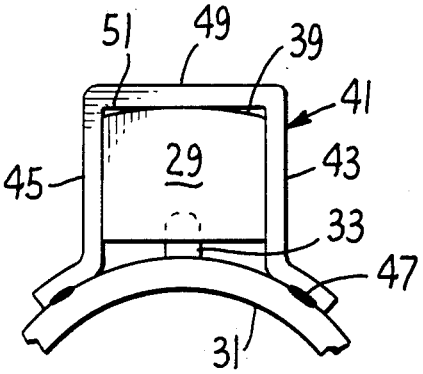
FIG. 3 is an enlarged end view of one of the support structures prior to insertion in the neck of a tube.
Figure 4:
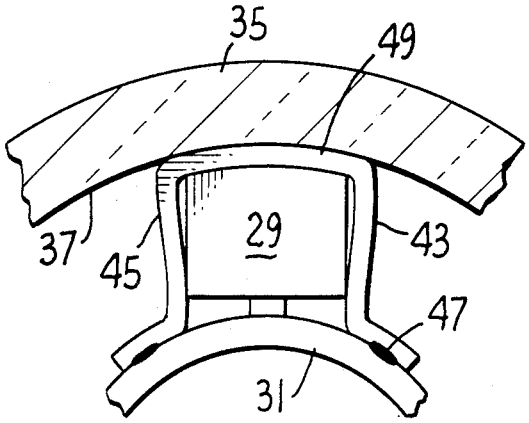
FIG. 4 is a similar view showing the support structure after it has been inserted in the neck of a tube.

The exact configuration of these straps is shown in FIGS. 3 and 4. FIG. 3 illustrates the configuration of a single support member prior to insertion in the neck of a tube while FIG. 4 shows the same support structure after it has been inserted in the neck of a tube. In accordance with the present invention, the glass rod 29 is attached to an electrode 31 by means of pins 33 which are fused into the rod 20 and attached to the electrode 31 by any suitable means, such as spot welding. The neck of the tube is designated 35 and the inner surface 37 of the tube is ground or shrunk or otherwise suitably formed to a precise dimension. In a practical embodiment of the invention, this inside diameter of the neck was held to a diameter of ±0.0005 inches. The outer surface 39 of the rod 29 is ground or otherwise formed so that it is congruent to the inner surface 37 of the neck and with a clearance equal to the thickness of a metal strap 41. In a practical embodiment, the outer surface was held to ±0.001 inches. Metal strap 41 is in the form of a U and has legs 43 and 45 which are fastened to the electrode 31, suitably by spot welding as at 47. The bight 49 of the U does not exactly conform to the rounded surface 39, but instead is substantially straight so that gaps, as at 51, are left at each edge of the rod 29. The assembly is then forced into the neck 35, as is shown in FIG. 4. This causes bight 49 to conform to the space between the inner surface 37 of the neck and the outer surface 39 of rod 29. This forces legs 43 and 45 to bow out slightly so that there is some tension on the legs. This maintains a tight sliding fit between the metal strap and the glass wall. There is thus sufficient friction between the metal strap and the glass wall as to preclude slippage, sliding and any other movement so the tube is stable even when subjected to great vibration. Further, the provision of the glass rods and the metal straps center the electrodes in the neck glass. In a practical embodiment of the invention, the positioning of the electrodes was reproducible within 0.001 inches in plant runs.

Figure 5:
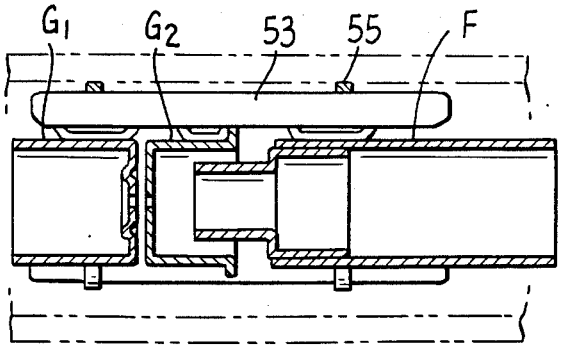
FIG. 5 is a partial side view, partly in section, illustrating the application of the invention to a conventional cross-over electron gun.

FIG. 5 shows how the invention can be applied to a conventional cross-over tube having the electrodes G1, G2 and the focus electrode F held in place by means of the glass rod 53 and the metal straps 55.

Figure 6:
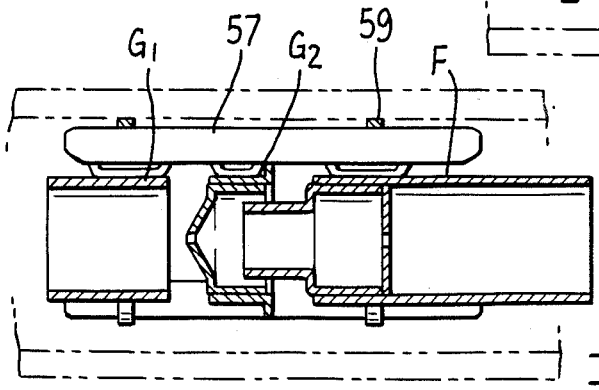
FIG. 6 is a view similar to FIG. 5 but showing the invention applied to an improved gun of the laminar flow type.

In FIG. 6 the invention is shown applied to a laminar flow tube wherein the electrodes are designated G1, G2 and F held in place by the glass rods 57 and straps 59.

Preferably, the support structures of the present invention are employed as three equally spaced glass rods, as is shown in FIGS. 1 and 2. However, a greater or smaller number might be employed.

In addition, the support structure of the present invention is ordinarily employed only at the ends of the glass rods, so that in the structure of FIG. 1, the metal straps are employed only on the grid 1 and focus electrodes but, of course, straps might be applied to more than two of the electrodes.

Many variations can be made in the exact structures illustrated without departing from the spirit of this invention.

I claim:

1. In an electron tube having at least a portion of the envelope in the form of an elongated tubular neck with a plurality of spaced electrodes mounted concentrically within said neck, the improvement comprising:

(a) a plurality of elongated glass rods surrounding said electrodes and lying parallel to said neck, (b) pins anchoring said rods to said electrodes, (c) the outer surface of said rods being convex and congruent to and spaced from the inner surface of said neck, (d) a plurality of metal straps each having a U-shape extending over said rods and being anchored on each side of a rod to an electrode, (e) the bight of the U forming a tight fit between the outer surface of the rod and the inner surface of the neck, and (f) the legs of the U being bowed outwardly and exerting tension in the neck.

2. The structure of claim 1 having three equally spaced glass rods.

3. The structure of claim 1 wherein two sets of straps are employed with one set at each end of the glass rods.

4. The structure of claim 1 wherein the electrodes form a cross-over gun in a CRT.

5. The structure of claim 1 wherein the electrodes form a laminar flow gun in a CRT.

* * * * *

UNITED STATES PATENT OFFICE

CERTIFICATE OF CORRECTION

Patent No. 4,618,800 Dated October 21, 1986

Inventor(s) Kenneth G. Gorman, Jr.

It is certified that error appears in the above-identified patent and that said Letters Patent are hereby corrected as shown below:

Column 2, line 1, change "sight" to read --- slight ---

Column 2, line 62, change "20" to read --- 29 ---

Signed and Sealed this

Sixth Day of January, 1987

*Attest:*

DONALD J. QUIGG

*Attesting Officer*

*Commissioner of Patents and Trademarks*